United States Patent [19]

Leifeld

[11] 4,171,552

[45] Oct. 23, 1979

[54] PILE SQUEEZING APPARATUS

[75] Inventor: Ferdinand Leifeld, Kempen, Fed. Rep. of Germany

[73] Assignee: Trutzschler GmbH & Co. KG, Mönchen-Gladbach, Fed. Rep. of Germany

[21] Appl. No.: 930,535

[22] Filed: Aug. 1, 1978

[30] Foreign Application Priority Data

Aug. 16, 1977 [DE] Fed. Rep. of Germany ..... 2736939

[51] Int. Cl.[2] ..... D01H 11/00

[52] U.S. Cl. ..... 15/256.53; 19/262; 100/174; 101/425

[58] Field of Search ..... 15/256.51, 256.53; 101/425; 100/174; 19/107, 262; 118/652; 57/56

[56] References Cited

U.S. PATENT DOCUMENTS

| | | | |
|---|---|---|---|
| 3,130,438 | 4/1964 | Hughes | 15/256.53 |
| 4,133,073 | 1/1979 | Marzoli | 15/256.51 X |

FOREIGN PATENT DOCUMENTS

| | | | |
|---|---|---|---|
| 916167 | 1/1963 | United Kingdom | 15/256.53 |

*Primary Examiner*—Edward L. Roberts
*Attorney, Agent, or Firm*—Hazeltine, Lake & Waters

[57] ABSTRACT

Pile squeezing apparatus with pile squeezing rollers between which a fiber strip can pass. Each of two stripping blades is associated with one of the pile squeezing rollers. The stripping blades is brought into pressure contact by an adjusting device, with the cylindrical surfaces of the pile squeezing rollers along their entire length. These stripping blades are listed from the rollers, and each stripping blade is movable back and forth parallel to the axis of its associated pile squeezing roller. Holders of the stripping blades are fastened to a common connecting element which is driven pneumatically. This connecting element is driven at a stroke of predetermined amplitude and frequency.

6 Claims, 2 Drawing Figures

PILE SQUEEZING APPARATUS

BACKGROUND OF THE INVENTION

The present invention relates to a fleece (pile) squeezing apparatus with pile squeezing rollers between which a fiber strip can be passed, with two stripping blades, one each being associated with one of the pile squeezing rollers; these stripping blades can be brought into pressure contact with the cylinder surfaces of the pile squeezing rollers along their entire length and can be lifted from these surfaces by means of an adjusting device.

During processing operations, impurities such as shell remainders etc. get stuck on the cylinder surfaces and result in the pile winding itself on the cylinder surface so that the operation of the carding apparatus must be interrupted. The problem frequently arises with cotton containing wax, with the impurities being deposited as lumps and adhering tightly on the cylinder surfaces; with the known pile squeezing apparatuses these lumps cannot be removed. With one such known pile squeezing apparatus, the stripper edges of the stripping blades are pressed under spring load against the squeezing rollers, with the adjusting devices for the spring loading devices being actuated by hand. It has been found that the pressure force is inadequate to ensure a thorough cleaning of the squeezing rollers and to prevent the aforementioned shutdowns.

It is, therefore, an object of the present invention to provide a pile squeezing apparatus with pile squeezing rollers and stripping blades which avoids the above shortcomings, ensuring a thorough cleaning of the squeezing rollers and preventing shutdowns.

Another object of the present invention is to prolong the life of the squeezing rollers, thus reducing operating cost.

A further object of the present invention is to provide an arrangement of the foregoing character which is substantially simple in construction and may be economically fabricated.

SUMMARY OF THE INVENTION

The objects of the present invention are achieved by making each stripping blade movable in reciprocating action parallel to the axis of its associated pile squeezing roller.

This reciprocating action is at right angles to the feed direction of the pile. As a result, the stripping blades come in contact with the squeezing rollers not only on the same cylinder surface line, but they also cover adjacent regions. Thus the circular contact between stripping blade and squeezing roller of the conventional design turns into helical contact so that per unit of time, a much larger surface is covered and cleaned by the stripping blades. In this manner, the squeezing rollers are thoroughly kept free of contamination, avoiding down-time and increasing the economic yield of the installation.

A simplification of construction can be achieved by fastening the holders of the stripping blades on a common connecting element. This results in synchronism of the back and forth (reciprocal) motions. This connecting element can be driven in a known manner, for example, hydraulically or mechanically. A pneumatic drive has low wear and requires little capital investment. It is advantageous to drive the connecting element with a stroke (i.e., the distance between motion reversals) of about 5 mm and a frequency of about 2 Hz.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
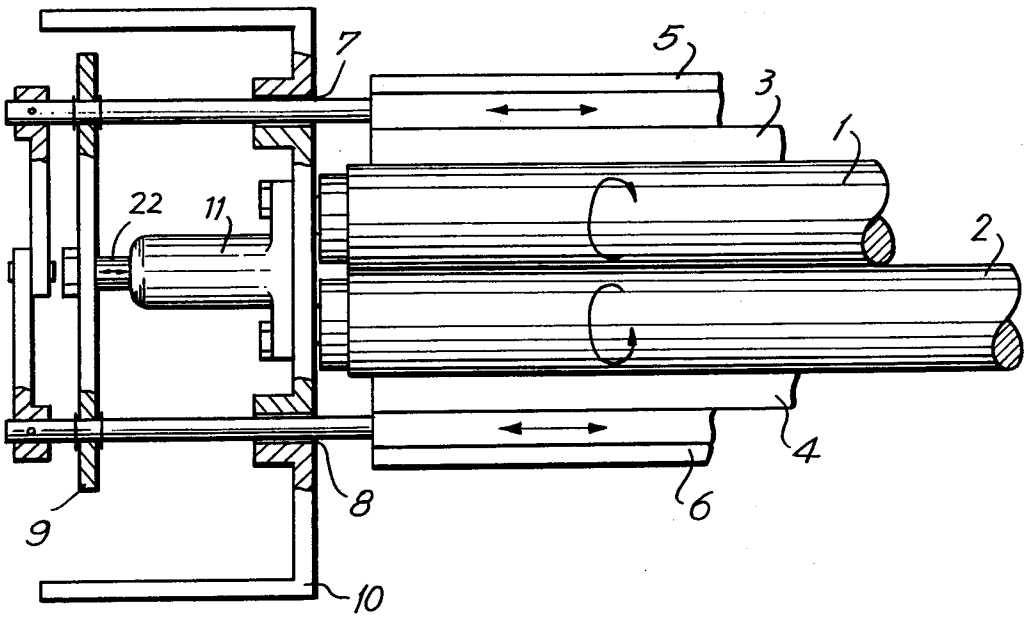
FIG. 1 shows a front view of a pile squeezing apparatus with two stripping blades.

FIG. 1 shows the pile squeezing rollers 1, 2 of a pile squeezing apparatus with two strippings blades 3, 4, each of which is associated with one of pile squeezing rollers 1, 2. The pile squeezing rollers 1, 2 and the stripping blades 3, 4 are substantially parallel to each other. The stripping blades 3, 4 are fastened to blade holders 5, 6 which are mounted in support bushings 7, 8 where they can be moved horizontally. The ends of the blade holders 5, 6 are installed in a common connecting element 9 on the side of the pile squeezing rollers 1, 2. Between the squeezing rollers 1, 2 and the connecting element 9, supported by frame 10, there is a pneumatic cylinder 11 whose pneumatic push-and-pull rod 22 is solidly attached, for example by screws, to the connecting element 9.

Figure 2:
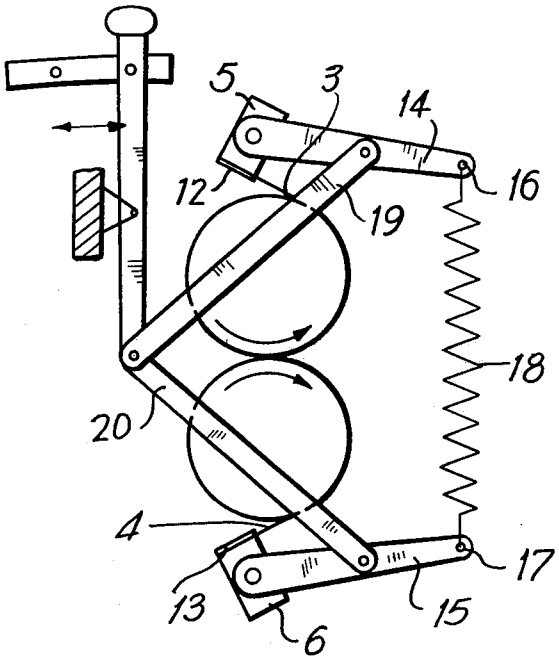
FIG. 2 shows a side view of the apparatus of FIG. 1.

According to FIG. 2, the stripping blades 3, 4 are fastened via holding elements 12, 13 to the blade holders 5, 6. Furthermore, a lever element 14, 15 is fastened to each of blade holders 5 and 6. The one end of lever arm 14, 15 associated with blade holder 5, 6 is the fulcrum point of lever arm 14, 15. The other, free end of lever arm 14, 15 has drill holes 16, 17 which are attached to the two ends of a tension spring 18. This spring pulls the lever arms 14, 15 together and thus presses the stripping blades against the cylinder surfaces of the squeezing rollers 1, 2. Finally, there is an auxiliary device made up of two hinged levers 19, 20. The hinged levers 19, 20 are joined at one end and are linked on their other end to lever arms 14, 15 between drill holes 16, 17 and the blade holders 5, 6. This auxiliary device is used to lift the stripping blades 3, 4 from the squeezing rollers 1, 2 since the hinged levers 19, 20 push the lever arms 14, 15 against the force of the tension spring 18 towards the outside.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A pile squeezing apparatus comprising: pile squeezing rollers between which fiber strip can pass; stripping blades, each of said stripping blades being associated with one of said pile squeezing rollers; adjusting means for bringing said stripping blades into pressure contact with cylindrical surfaces of said pile squeezing rollers along an entire length of said cylindrical surfaces and for lifting said stripping blades from said pile squeezing rollers, said stripping blades being movable back and forth parallel to an axis of their associated pile squeezing rollers.

2. Apparatus as defined in claim 1 including holders for said stripping blades; and common connecting means fastened to said holders.

3. Apparatus as defined in claim 1 including means for driving said common connecting means pneumatically.

4. Apparatus as defined in claim 3 wherein said connecting means is driven at a stroke of substantially 5 mm and at a frequency of substantially 2 Hz.

5. Apparatus as defined in claim 1 wherein said stripping blades comprise two blades.

6. Apparatus as defined in claim 1 including holders for said stripping blades; common connecting means fastened to said holders; means for driving said common connecting means pneumatically; said stripping blades comprising two blades; said common connecting means being driven at a stroke of substantially 5 mm and at a frequency of substantially 2 Hz.

* * * * *